US010157561B2

(12) United States Patent
Yan et al.

(10) Patent No.: US 10,157,561 B2
(45) Date of Patent: Dec. 18, 2018

(54) ELECTRONIC DEVICE DISPLAY WITH ZIGZAG PIXEL DESIGN

(71) Applicant: Apple Inc., Cupertino, CA (US)

(72) Inventors: Jin Yan, Santa Clara, CA (US); Young Cheol Yang, Sunnyvale, CA (US); Jun Jiang, Campbell, CA (US); Hao-Lin Chiu, Campbell, CA (US); Young-Jik Jo, Santa Clara, CA (US); Cheng Chen, San Jose, CA (US)

(73) Assignee: Apple Inc., Cupertino, CA (US)

( * ) Notice: Subject to any disclaimer, the term of this patent is extended or adjusted under 35 U.S.C. 154(b) by 590 days.

(21) Appl. No.: 14/863,142

(22) Filed: Sep. 23, 2015

(65) Prior Publication Data

US 2016/0321975 A1 Nov. 3, 2016

Related U.S. Application Data

(60) Provisional application No. 62/156,150, filed on May 1, 2015.

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 3/3648* (2013.01); *G09G 2300/023* (2013.01); *G09G 2320/0238* (2013.01); *G09G 2320/0242* (2013.01)

(58) Field of Classification Search
CPC ... G09G 3/2003; G09G 3/3607; G09G 3/3648
See application file for complete search history.

(56) References Cited

U.S. PATENT DOCUMENTS 8,125,609 B2 2/2012 Ahn
8,269,404 B2 * 9/2012 Cho ..... B29C 33/42 313/112
8,605,239 B2 12/2013 Ong
9,105,247 B2 8/2015 Lin et al.
2002/0037600 A1 * 3/2002 Hirabayashi ..... H01L 31/02164 438/30
2002/0140883 A1 * 10/2002 Okamoto ..... G02F 1/136209 349/110

(Continued)

FOREIGN PATENT DOCUMENTS

WO 2015104239 7/2015

*Primary Examiner* — Lucy P Chien
(74) *Attorney, Agent, or Firm* — Treyz Law Group, P.C.; Jason Tsai

(57) ABSTRACT

A display may have a first stage such as a color liquid crystal display stage and a second stage such as a monochromatic liquid crystal display stage that are coupled in tandem so that light from a backlight passes through both stages. The pixel pitch of the second stage may be greater than the pixel pitch of the first stage to ease alignment tolerances and reduce image processing complexity. The first stage may be provided with straight black masking strips, whereas the second stage may be provided with angled zigzagging black masking strips. The angle of the zigzagging black masking strips and the ratio of the pixel pitch of the second stage to that of the first stage may be selected to maximize optical transmittance while minimizing Moire effects.

20 Claims, 9 Drawing Sheets

(56) References Cited

U.S. PATENT DOCUMENTS

| | | | | |
|---|---|---|---|---|
| 2002/0159016 | A1* | 10/2002 | Nishida | G02F 1/134363 349/141 |
| 2006/0061538 | A1* | 3/2006 | Dispoto | G09G 3/3426 345/102 |
| 2010/0013912 | A1* | 1/2010 | Lee | G02B 27/2214 348/59 |
| 2014/0063300 | A1 | 3/2014 | Lin et al. | |
| 2015/0355514 | A1* | 12/2015 | Lin | G02F 1/133602 349/44 |

* cited by examiner

ELECTRONIC DEVICE DISPLAY WITH ZIGZAG PIXEL DESIGN

This application claims the benefit of provisional patent application No. 62/156,150 filed on May 1, 2015, which is hereby incorporated by reference herein in its entirety.

BACKGROUND

This relates generally to electronic devices and, more particularly, to electronic devices with displays. Electronic devices often include displays. For example, cellular telephones, computers, and televisions have displays.

Liquid crystal displays create images by modulating the intensity of light that is being emitted from a backlight. The perceived quality of a liquid crystal display is affected by its dynamic range. The dynamic range of a display is the ratio of the output of the display at its brightest setting to the output of the display at its dimmest setting. Because it is not possible to completely extinguish the light produced by the backlight in a liquid crystal display, the dynamic range of a liquid crystal display is limited. A typical liquid crystal display has a dynamic range of about 1000:1. When viewing content such as movies where dark areas are often present, the limited dynamic range of a conventional display can have an adverse impact on picture quality. For example, black areas of an image may appear to be dark gray rather than black.

It would therefore be desirable to be able to provide improved displays such as improved liquid crystal displays.

SUMMARY

An electronic device may generate content that is to be displayed on a display. The display may be a liquid crystal display have an array of liquid crystal display pixels. Display driver circuitry in the display may display image frames on the array of pixels.

In accordance with an embodiment, a two-stage display is provided that includes a color upper stage having color filter elements, a monochromatic lower stage, and black masking structures that are formed in the monochromatic lower stage and that are formed in a zigzagging arrangement. Additional black masking structures may be formed in the color upper stage and are formed in a straight arrangement. Formed in this way, the black masking structures in the lower stage may therefore be formed at an angle with respect to the additional black masking structures in the upper stage. The upper stage may include pixels with a first pitch, whereas the lower stage may include pixels with a second pitch that is greater than the first pitch.

The black masking structures in the lower stage may substantially cover gate lines or data lines that are coupled to the pixels in the lower stage. In one suitable arrangement, the black masking structures may include adjacent zigzagging strips that are in-phase with each other. In another suitable arrangement, the black masking structures may include adjacent zigzagging strips that are out-of-phase with each other (e.g., 180 degrees phase offset with respect to each other).

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Electronic devices may include displays. The displays may be used to display images to a user. Illustrative electronic devices that may be provided with displays are shown in FIGS. 1, 2, 3, and 4.

Figure 1:
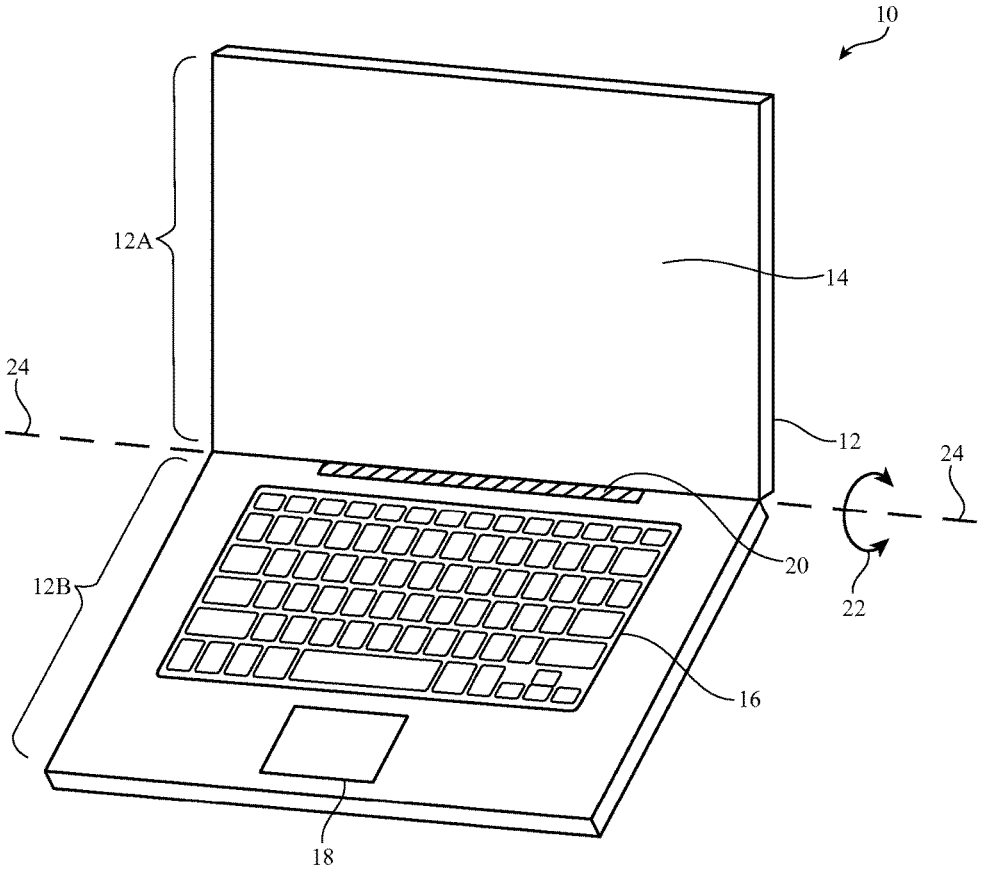
FIG. 1 is a perspective view of an illustrative electronic device such as a laptop computer with a display in accordance with an embodiment.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
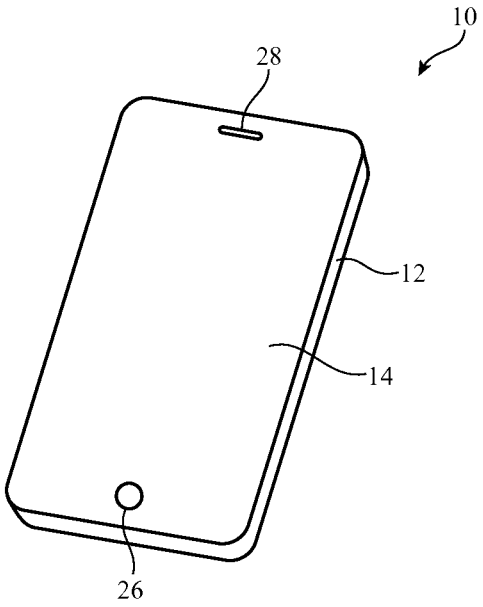
FIG. 2 is a perspective view of an illustrative electronic device such as a handheld electronic device with a display in accordance with an embodiment.

FIG. 2 shows how electronic device 10 may be a handheld device such as a cellular telephone, music player, gaming device, navigation unit, watch, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2). In compact devices such as wrist-watch devices, port 28 and/or button 26 may be omitted and device 10 may be provided with a strap or lanyard.

Figure 3:
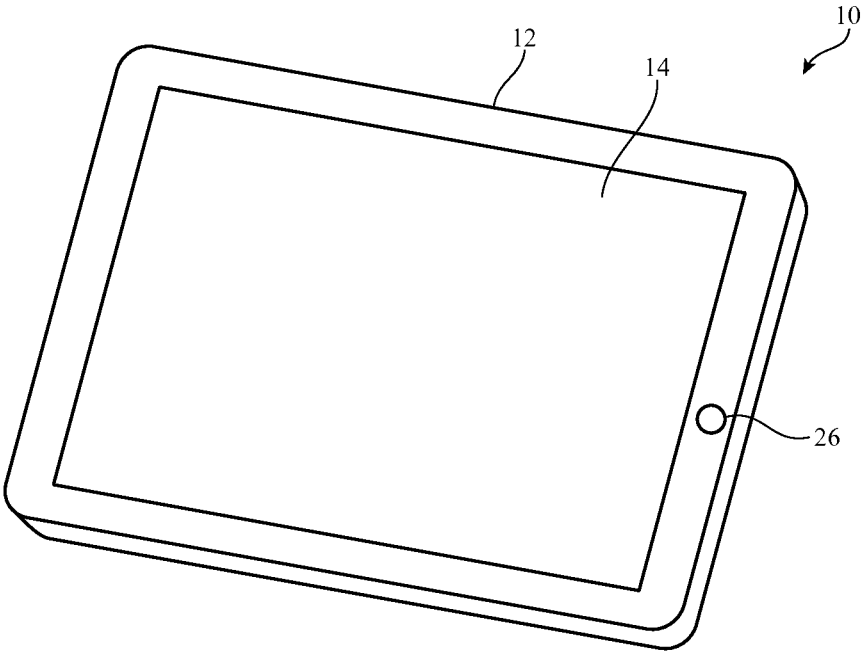
FIG. 3 is a perspective view of an illustrative electronic device such as a tablet computer with a display in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
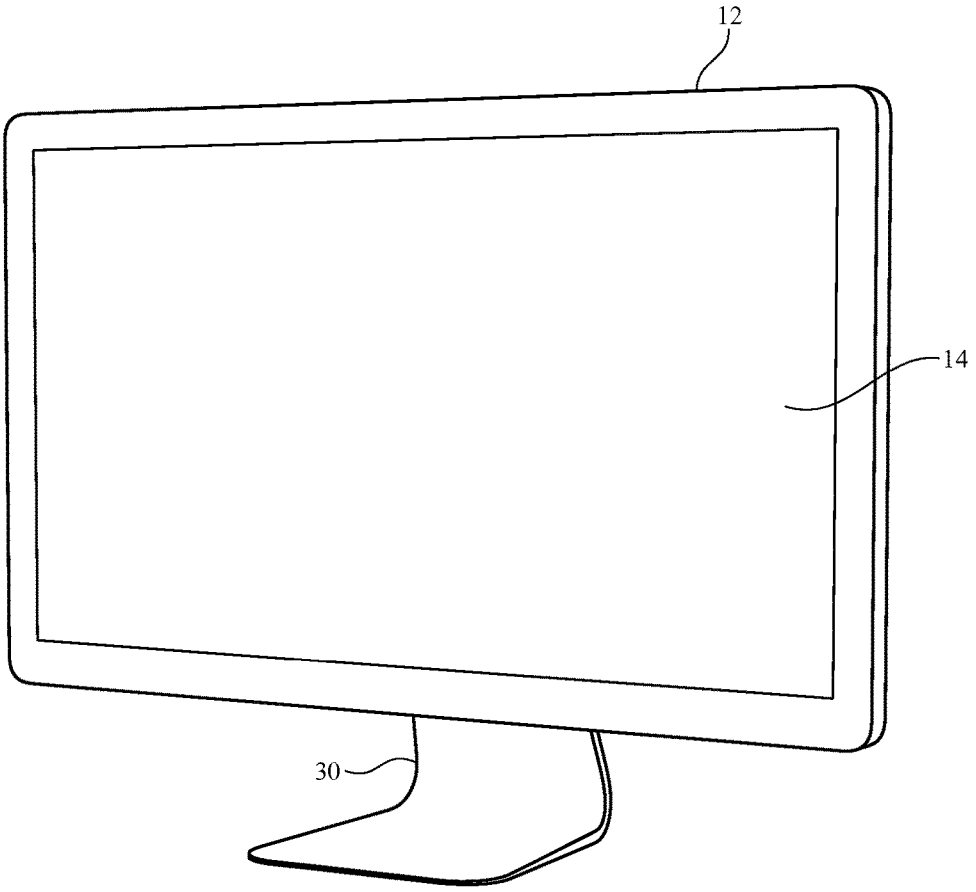
FIG. 4 is a perspective view of an illustrative electronic device such as a computer or other device with display structures in accordance with an embodiment.

FIG. 4 shows how electronic device 10 may be a display such as a computer monitor, a computer that has been integrated into a computer display, or other device with a built-in display. With this type of arrangement, housing 12 for device 10 may be mounted on a support structure such as stand 30 or stand 30 may be omitted (e.g., to mount device 10 on a wall). Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include pixels formed from liquid crystal display (LCD) components. A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
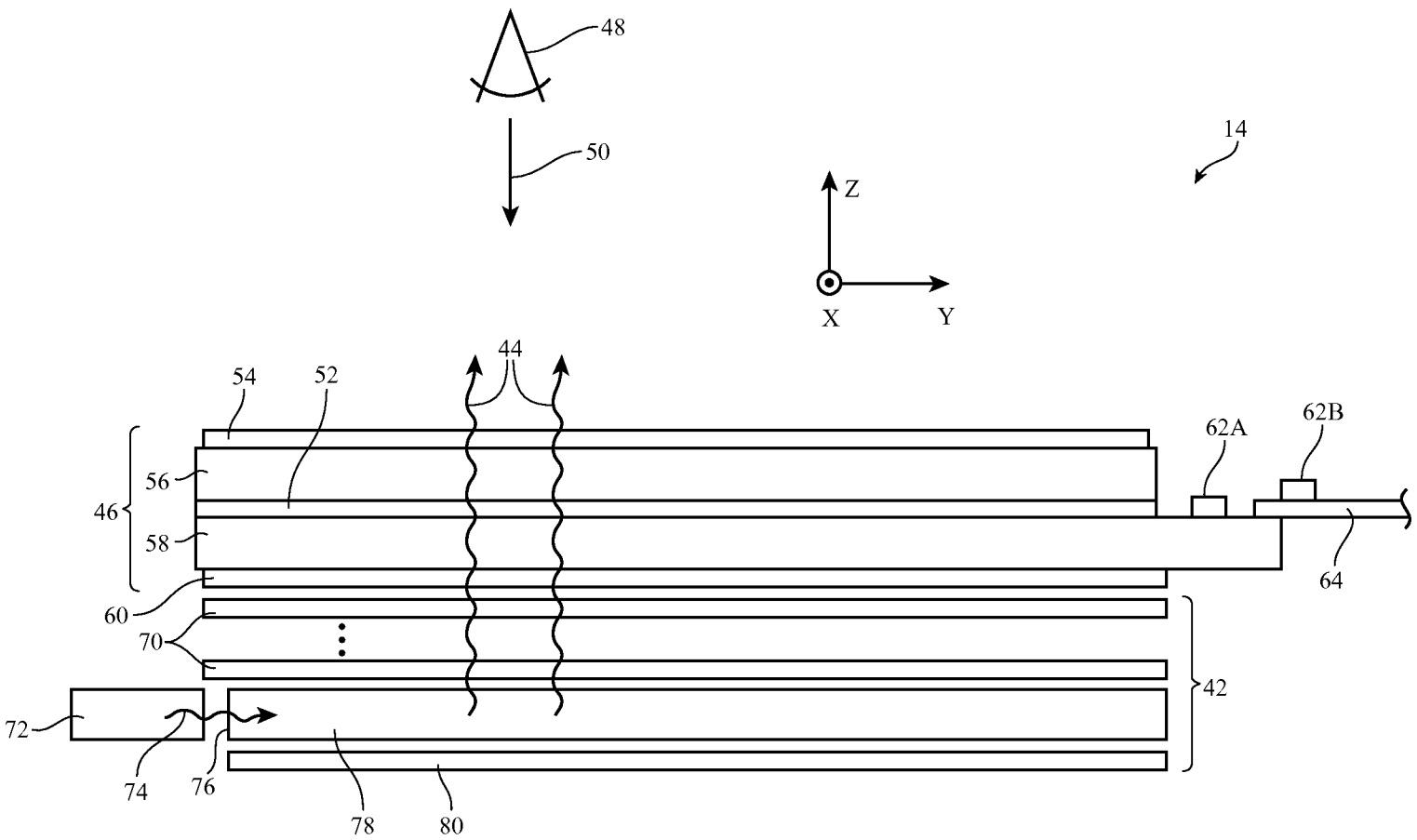
FIG. 5 is a cross-sectional side view of an illustrative display in accordance with an embodiment.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

Display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 58 and 56 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of pixel circuits based on thin-film transistors and associated electrodes (pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer. Configurations in which color filter elements are combined with thin-film transistor structures on a common substrate layer in the upper or lower portion of display 14 may also be used.

During operation of display 14 in device 10, control circuitry (e.g., one or more integrated circuits on a printed circuit) may be used to generate information to be displayed on display 14 (e.g., display data). The information to be displayed may be conveyed to a display driver integrated circuit such as circuit 62A or 62B using a signal path such as a signal path formed from conductive metal traces in a rigid or flexible printed circuit such as printed circuit 64 (as an example).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78. Light source 72 may be located at the left of light guide plate 78 as shown in FIG. 5 or may be located along the right edge of plate 78 and/or other edges of plate 78.

Light 74 that scatters upwards in direction Z from light guide plate 78 may serve as backlight 44 for display 14.

Light 74 that scatters downwards may be reflected back in the upwards direction by reflector 80. Reflector 80 may be formed from a reflective material such as a layer of plastic covered with a dielectric mirror thin-film coating.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint. If desired, films such as compensation films may be incorporated into other layers of display 14 (e.g., polarizer layers).

Figure 6:
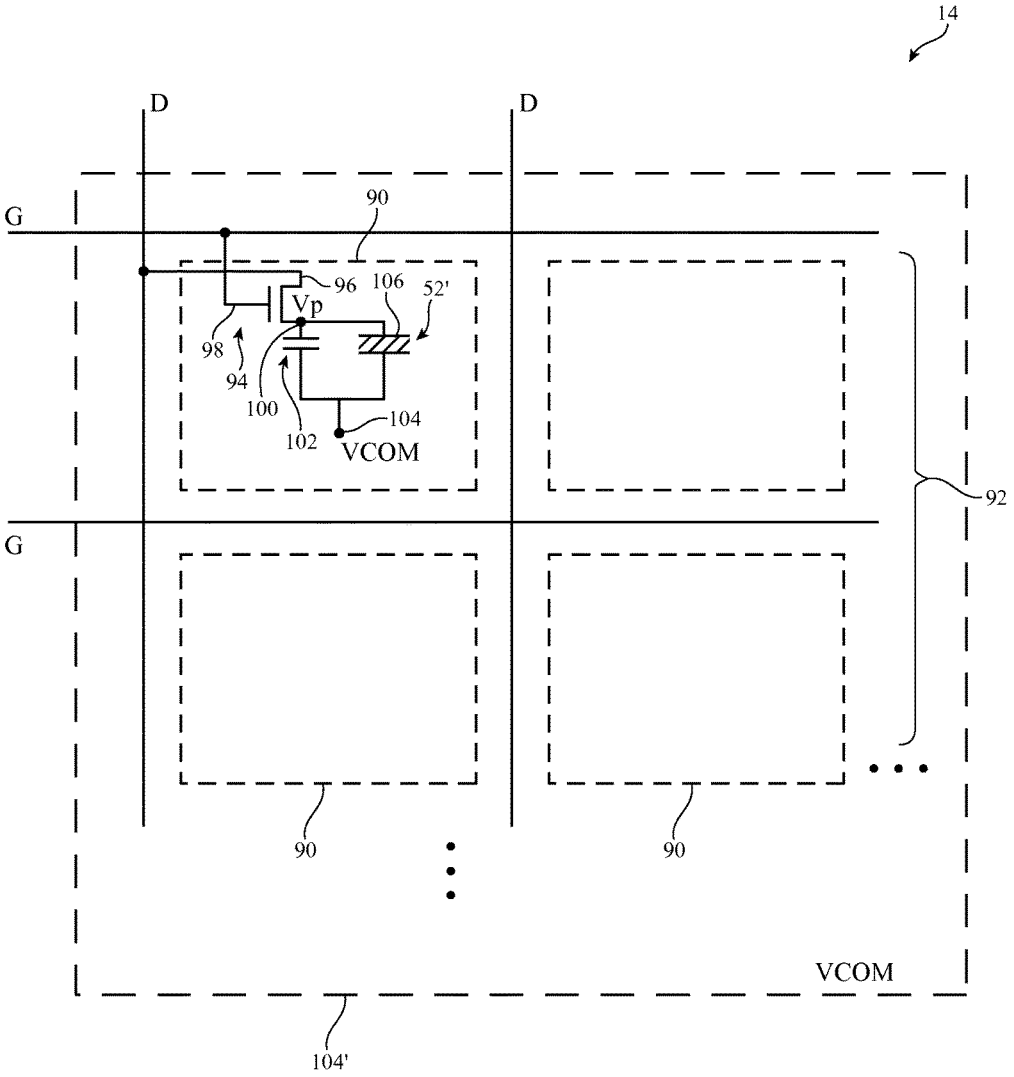
FIG. 6 is a top view of a portion of an array of pixels in a display in accordance with an embodiment.

As shown in FIG. 6, display 14 may include an array of pixels 90 such as pixel array 92. Pixel array 92 may be controlled using control signals produced by display driver circuitry. Display driver circuitry may be implemented using one or more integrated circuits (ICs) and/or thin-film transistors or other circuitry.

During operation of device 10, control circuitry in device 10 such as memory circuits, microprocessors, and other storage and processing circuitry may provide data to the display driver circuitry. The display driver circuitry may convert the data into signals for controlling pixels 90 of pixel array 92.

Pixel array 92 may contain rows and columns of pixels 90. The circuitry of pixel array 92 (i.e., the rows and columns of pixel circuits for pixels 90) may be controlled using signals such as data line signals on data lines D and gate line signals on gate lines G. Data lines D and gate lines G are orthogonal. For example, data lines D may extend vertically and gate lines G may extend horizontally (i.e., perpendicular to data lines D).

Gate driver circuitry may be used to generate gate signals on gate lines G. The gate driver circuitry may be formed from thin-film transistors on the thin-film transistor layer or may be implemented in separate integrated circuits. The data line signals on data lines D in pixel array 92 carry analog image data (e.g., voltages with magnitudes representing pixel brightness levels). During the process of displaying images on display 14, a display driver integrated circuit or other circuitry may receive digital data from control circuitry and may produce corresponding analog data signals. The analog data signals may be demultiplexed and provided to data lines D.

The data line signals on data lines D are distributed to the columns of display pixels 90 in pixel array 92. Gate line signals on gate lines G are provided to the rows of pixels 90 in pixel array 92 by associated gate driver circuitry.

The circuitry of display 14 may be formed from conductive structures (e.g., metal lines and/or structures formed from transparent conductive materials such as indium tin oxide) and may include transistors such as transistor 94 of FIG. 6 that are fabricated on the thin-film transistor substrate layer of display 14. The thin-film transistors may be, for example, silicon thin-film transistors or semiconducting-oxide thin-film transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor, an amorphous silicon transistor, or an oxide transistor such as a transistor formed from a semiconducting oxide such as indium gallium zinc oxide) may have a gate terminal such as gate 98 that receives gate line control signals on gate line G. When a gate line control signal is asserted, transistor 94 will be turned on and the data signal at terminal 96 will be passed to node 100 as pixel voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to help store signal Vp in pixel 90 between frames (i.e., in the period of time between the assertion of successive gate signals).

Display 14 may have a common electrode coupled to node 104. The common electrode (which is sometimes referred to as the common voltage electrode, Vcom electrode, or Vcom terminal) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide, indium zinc oxide, other transparent conductive oxide material, and/or a layer of metal that is sufficiently thin to be transparent (e.g., electrode 104 may be formed from a layer of indium tin oxide or other transparent conductive layer that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 (e.g., a display pixel electrode with multiple fingers or other display pixel electrode for applying electric fields to liquid crystal material 52') may be coupled to node 100 (or a multi-finger display pixel electrode may be formed at node 104). During operation, electrode structures 106 may be used to apply a controlled electric field (i.e., a field having a magnitude proportional to Vp-Vcom) across pixel-sized liquid crystal material 52' in pixel 90. Due to the presence of storage capacitor 102 and the parallel capacitances formed by the pixel structures of pixel 90, the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 5, be used in controlling the amount of light 44 that is transmitted through each pixel 90 in array 92 of display 14 so that image frames may be displayed on display 14.

Figure 7:
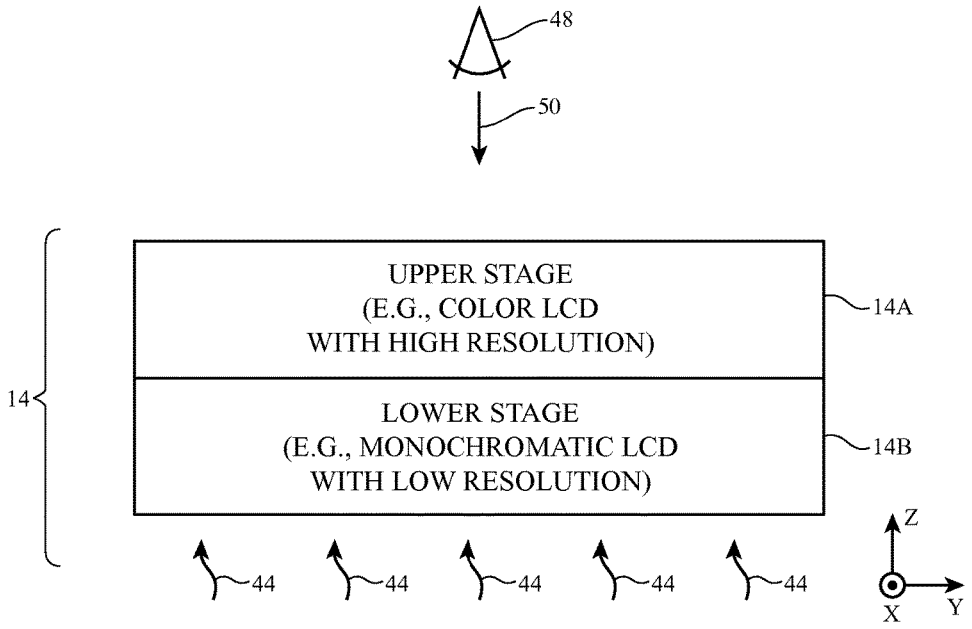
FIG. 7 is a cross-sectional side view of an illustrative two stage liquid crystal display in accordance with an embodiment.

The dynamic range of a single-stage display of the type shown in FIG. 6 can be enhanced by incorporating one or more additional liquid crystal display stages into display 14. As shown in FIG. 7, display 14 may, for example, be provided with a pair of tandem display stages such as upper stage 14A and lower stage 14B.

To provide display 14 with the ability to display images, display 14 may be provided with an array of color filter elements. The color filter element array may be formed by patterning colored photoimageable polymer areas on the underside of a transparent glass or plastic substrate (see, e.g., color filter layer 56 of FIG. 5). Only one of the display stages in display 14 need be provided with a color filter array. In the example of FIG. 7, upper stage 14A has an array of color filter elements and lower stage 14B does not have any color filter elements. Lower stage 14B is a monochromatic (gray-level) display that can modulate the intensity of backlight 44, but does not impart color information to backlight 44. Upper stage 14A contains a color filter array and has corresponding pixels to create color images for viewer 48. Because upper stage 14A has the ability to display color images, upper stage 14A may sometimes be referred to as a color stage. Because lower stage 14B displays only pixels of varying shades of gray (ranging from black to white), lower stage 14B may sometimes be referred to as a monochromatic stage, shutter stage, or localized dimming stage. In the illustrative configuration of FIG. 7, the upper stage of display 14 is a color stage and the lower stage of display 14 is a monochromatic stage, but the upper stage may be monochromatic and the lower stage may be a color stage, if desired.

It is not necessary for both display stages in display 14 to be high resolution stages (i.e., both stages need not have small pixel pitches). Rather, one of the stages such as upper stage 14A may have a relatively high resolution (e.g., the overall display resolution desired for display 14), whereas the other stage such as lower stage 14B may have a reduced resolution. Local stage 14B may be used to apply local dimming to dark areas of the image being displayed on display 14, rather using stage 14B to display full-resolution images. The use of localized dimming helps enhance dynamic range. For example, in an image that has dark areas, the darkness of the dark areas can be enhanced by locally dimming the dark areas with stage 14B (i.e., by creating additional dimming in addition to darkening the pixels of the dark areas with stage 14A).

In accordance with an embodiment, display 14 of the type described in connection with FIG. 7 may be provided with light blocking structures to further enhance the optical performance of the display. The light blocking structures may be formed from a black masking layer that is patterned to form a black mask. The black mask may be a grid-shaped series of intersecting opaque lines that define a regular array of pixel openings. Opaque masking structures formed in this way may sometimes be referred to as a black matrix and may serve to prevent light associated with a given display pixel from leaking into an adjacent pixel location or into the inactive region of the display.

Figure 8:
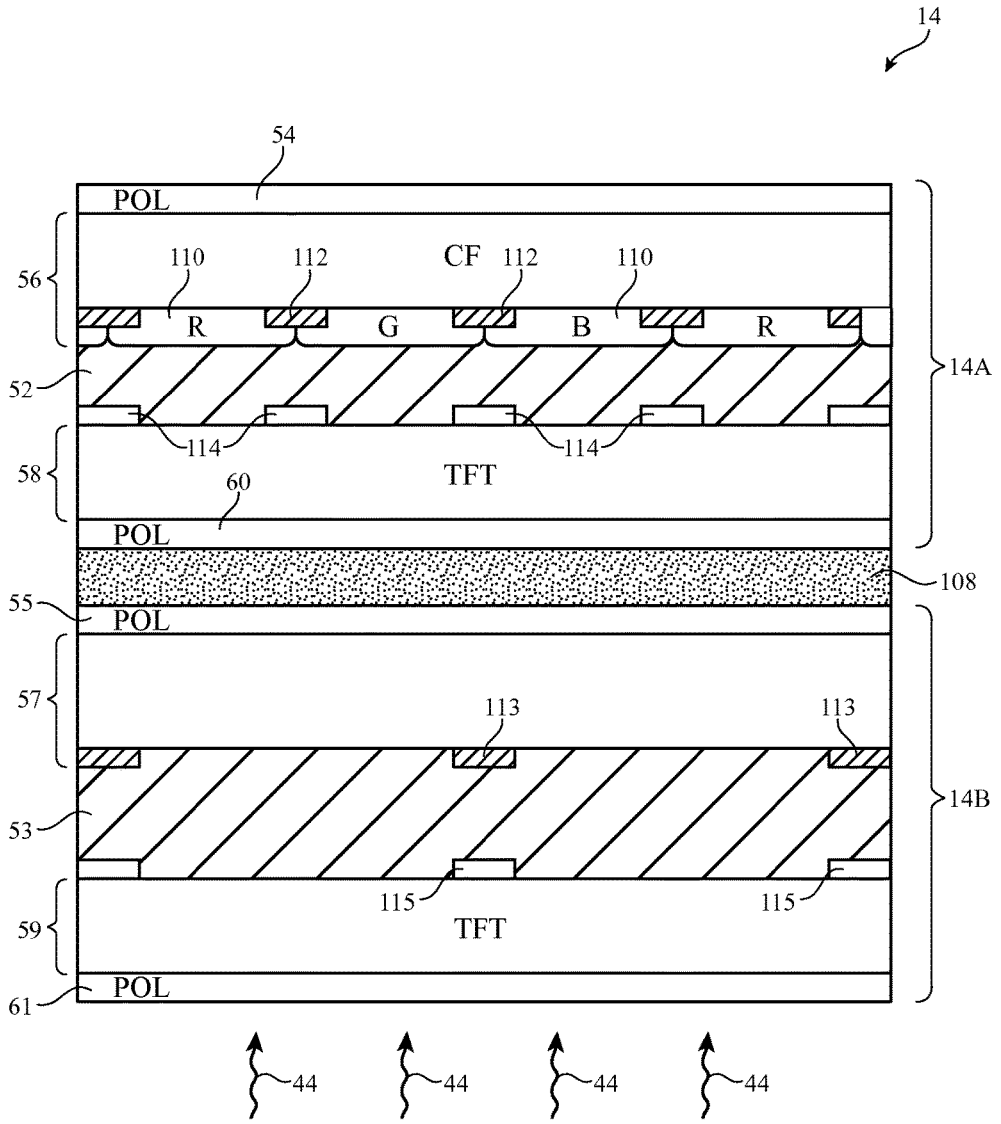
FIG. 8 is a cross-sectional side view of an illustrative two stage liquid crystal display having black masking layers in accordance with an embodiment.

FIG. 8 is a cross-sectional side view of an illustrative two stage liquid crystal display having black masking structures. In the example of FIG. 8, upper stage 14A may include black masking structures 112 that are formed on the transparent substrate of the color filter layer 56. Black masking structure 112 may be formed from photoimageable material such as black photoresist (e.g., black polyimide), metal, or other opaque material. The black masking structures 112 may have openings in which color filter elements 110 are formed. Gate lines 114 formed as part of TFT layer 58 (e.g., gate lines G of the type described in FIG. 6) may be covered by the black masking structures 112. This is merely illustrative. In other suitable arrangements, data lines (e.g., data lines D of FIG. 6) in TFT layer 58 may instead be covered by the black masking structures 112 in layer 56.

Similar to the upper stage 14A, lower stage 14B may include a liquid crystal layer such a liquid crystal layer 53 that is sandwiched between display layers such as display layers 57 and 59. Layers 57 and 59 may be interposed between lower polarizer layer 61 and upper polarizer layer 55. Layers 57 and 59 may be formed from transparent substrate layers such as clear layers of glass or plastic. Layers 57 and 59 may be layers such as a thin-film transistor layer and/or a light blocking layer. Conductive traces, color filter elements, transistors, and other circuits and structures may be formed on the substrates of layers 57 and 59 (e.g., to form a thin-film transistor layer and/or a black masking layer).

In the example of FIG. 8, layer 59 may be a thin-film transistor (TFT) layer that includes an array of pixel circuits based on thin-film transistors and associated electrodes (pixel electrodes) for applying electric fields to liquid crystal layer 53 and thereby displaying a low resolution monochromatic version of the image content for display 14. If desired, layer 59 may be a black masking layer and layer 57 may be a thin-film transistor layer. Configurations in which black masking elements are combined with thin-film transistor structures on a common substrate layer in the upper or lower portion of stage 14B may also be used.

In accordance with another embodiment, lower stage 14B may also include black masking structures 113 that are formed on the transparent substrate of layer 57. Black masking structure 113 may be formed from photoimageable material such as black photoresist (e.g., black polyimide), metal, or other opaque material. The black masking structures 113 may have openings corresponding to respective pixels formed in TFT layer 59. Gate lines 115 formed as part of TFT layer 59 (e.g., gate lines G of the type described in FIG. 6) may be covered by the black masking structures 113 (e.g., gate lines may substantially overlap with the opaque portion of the black masking grid). This is merely illustrative. In other suitable arrangements, the opaque portion of the black matrix may be substantially overlapping with the data lines (e.g., data lines D of FIG. 6) in TFT layer 59. In general, the wider control lines should be masked using the opaque light blocking structures. In other words, if the gate lines in layer 59 are wider than the data lines, the gate lines should be masked using opaque structures 113. Alternatively, if the data lines in layer 59 are wider than the gate lines, the data lines should be masked using opaque structures 113.

Still referring to FIG. 8, the upper stage 14A and the lower stage 14B may be attached via a diffuser 108 for helping to homogenize backlight 44 that is traveling through both stages. If desired, other types of brightness enhancement films may also be interposed between the upper and lower stages of display 14. In yet other suitable arrangements, diffuser 108 may be removed and a single polarizer may be shared between upper stage 14A and lower stage 14B (e.g., by merging polarizing layers 60 and 55 into a single layer).

Figure 9:
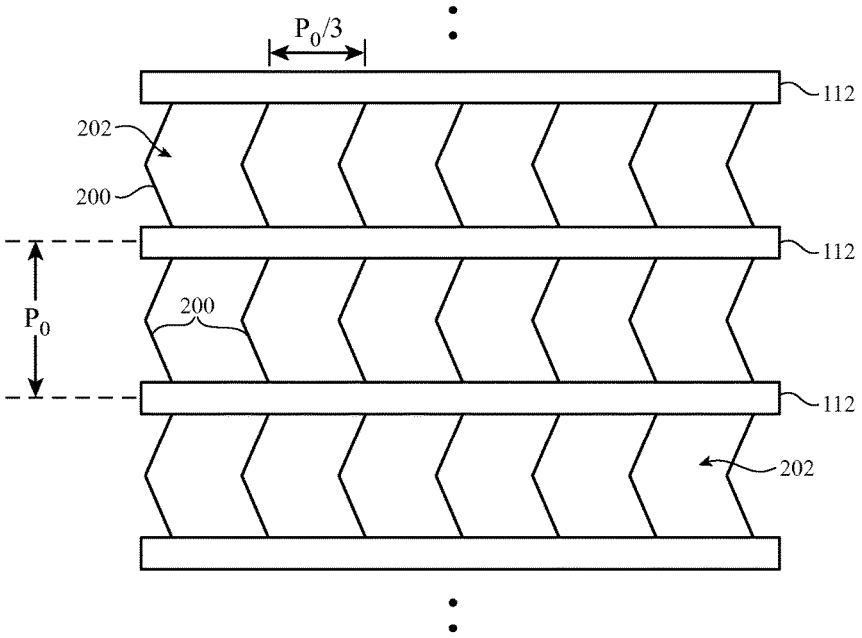
FIG. 9 is a top view showing the arrangement of a black mask in the upper stage of the two stage liquid crystal display of FIG. 8 in accordance with an embodiment.

FIG. 9 is a top view showing how the black masking structures 112 of upper stage 14A (sometimes referred to as the "front cell") may be patterned. As shown in FIG. 9, black masking structures 112 may be formed as horizontal strips, whereas control lines 200 (e.g., gate lines or data lines in layer 58) may be routed substantially orthogonal to the black masking strips. If desired, the control lines 200 may also be covered by zigzagging black masking material. Each region 202 defined by a pair of control lines 200 and black masking lines 112 may serve as a subpixel region (e.g., a red subpixel region, a green subpixel region, or a blue subpixel region) and may include pixel electrodes for implementing twisted nematic field effect (TN) matrix LCDs, in-plane switching (IPS) LCDs, fringe-field switching (FFS) LCDs, vertical alignment (VA) LCDs, or other types of LCD screening technology. Each subpixel region 202 may have a length $p_0$ and a width $p_0/3$. The chevron shape of region 202 is merely illustrative. If desired, regions 202 may have any suitable shape.

Figure 10:
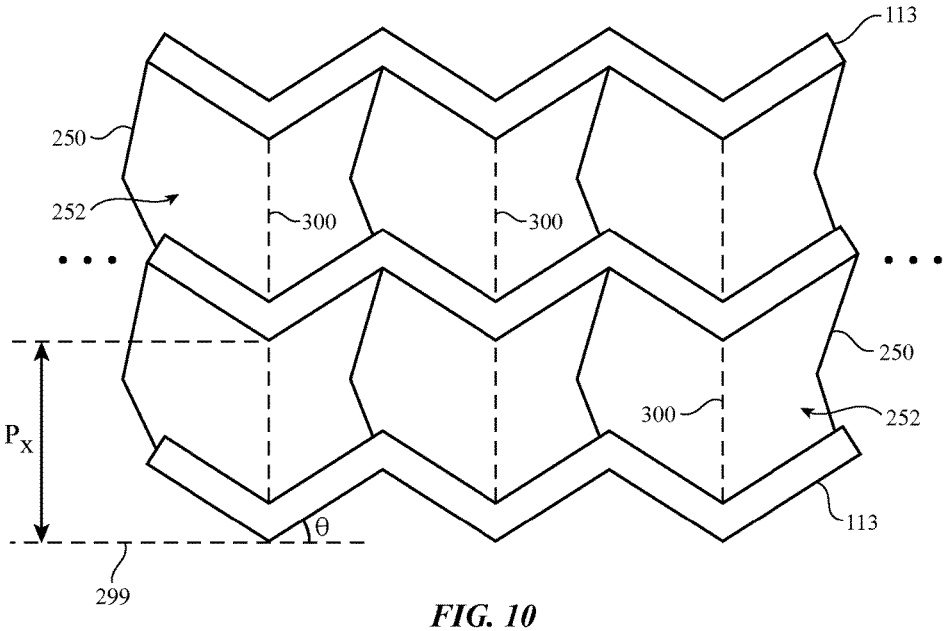
FIG. 10 is a top view showing an illustrative black mask with a zigzag arrangement in the lower stage of the two stage liquid crystal display of FIG. 8 in accordance with an embodiment.

FIG. 10 is a top view showing how the black masking structures 113 of lower stage 14B (sometimes referred to as the "back cell") may be formed. As shown in FIG. 10, black masking structures 113 may be formed as zigzagging strips, whereas control lines 250 (e.g., gate lines or data lines in layer 59) may be routed substantially orthogonal to the black masking strips 113. If desired, control lines 250 may also be covered by zigzagging black masking structures. In particular, whereas the distance between adjacent strips 113 may be defined as $p_x$. In general, distance $p_x$ (sometimes referred to as the pixel "pitch") may be greater than pitch $p_0$ of the upper stage so that the lower stage is provided with the lower resolution.

Each region 252 defined by a pair of control lines 250 and black masking lines 113 may serve as a respective low resolution pixel region for lower stage 14B. Pixel electrodes for implementing twisted nematic field effect (TN) matrix LCDs, in-plane switching (IPS) LCDs, fringe-field switching (FFS) LCDs, vertical alignment (VA) LCDs, or other types of LCD screening technology may be formed in region 252.

Still referring to FIG. 10, the black masking strips 113 may zigzag at an angle θ relative to a horizontal reference line 299. Forming the black masking structures 113 in such zigzagging pattern in the back cell (relative to the horizontal strips 112 in the front cell) can help reduce undesired Moire effects in the final displayed image. This enhancement is particularly pronounced for dual stage LCD structures that can potentially suffer from lateral or angular misalignment issues between the upper and lower stages. In general, angle θ should be any non-zero angle (e.g., any angle between the range of 20° and 50° and preferably in the range of 30-45°) to help optimize transmittance. The ratio of distance $p_x$ to distance $p_0$ (which can sometimes be referred to as a pixel-per-inch or PPI ratio) can also impact transmittance. In general, the PPI ratio should be any non-integer number that is greater than one (e.g., any number between one and five and preferably in the range of two and three).

The exemplary configurations of FIGS. 9 and 10 in which control lines 200 and 250 are angled are merely illustrative. In other suitable arrangements, control lines that are orthogonal to the black masking strips may be formed as vertical straight lines without any angles (e.g., as vertical gate lines or data lines).

Figure 11:
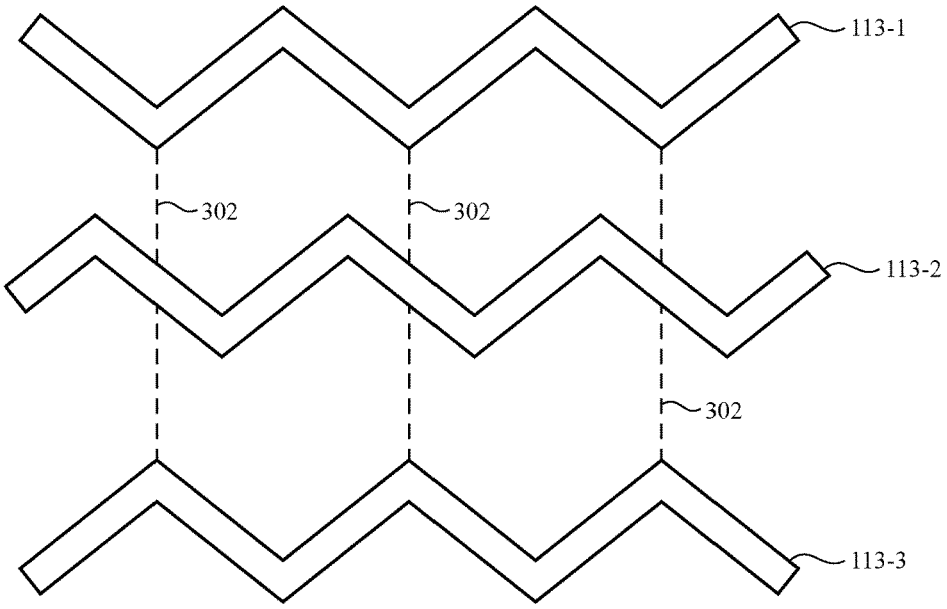
FIG. 11 is a top view illustrating how a zigzag black mask pattern may exhibit an incremental phase offset configuration in accordance with an embodiment.

The embodiment of FIG. 10 in which black masking structures 113 are all aligned or in-phase with one another (as indicated by dotted line 300) is merely illustrative and does not serve to limit the scope of the present invention. FIG. 11 shows another suitable embodiment illustrating how the black masking structures 113 may be incrementally offset from one another. As shown in FIG. 11, a first zigzagging strip 113-1 may have downward vertices aligned with dotted lines 302, whereas a third zigzagging strip 113-3 may have upward vertices aligned with lines 302. A second zigzagging strip 113-2 that is interposed between strips 113-1 and 113-3 may have upward/downward vertices neither of which are aligned with lines 302. The configuration of FIG. 11 may therefore be referred to as exhibiting a 90° phase offset between adjacent strips 113.

Figure 12:
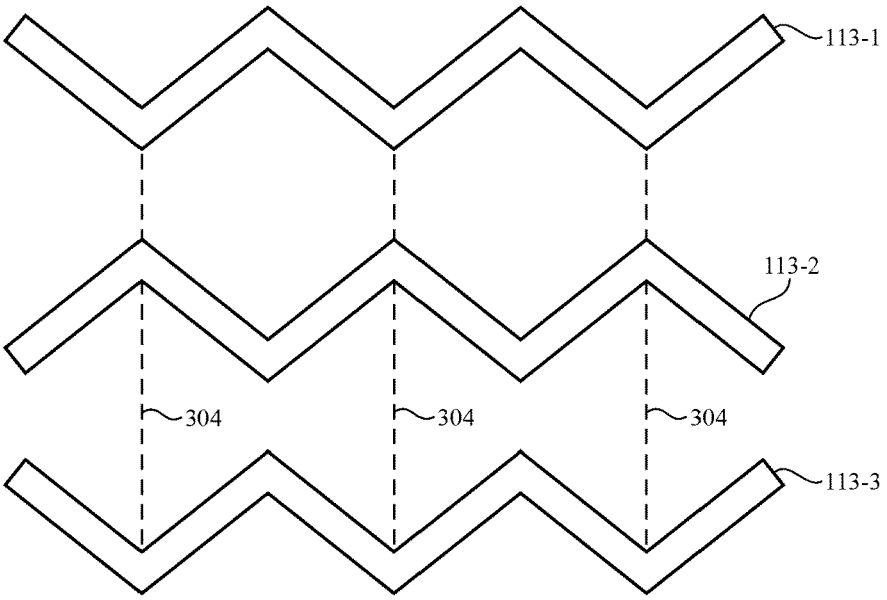
FIG. 12 is a top view illustrating how a zigzag black mask pattern may exhibit an out-of-phase configuration in accordance with an embodiment.

In general, the black masking structures 113 in the lower stage may exhibit any degree of phase offset (e.g., at least a 15° phase offset, at least a 30° phase offset, at least a 45° phase offset, etc.). FIG. 12 shows another suitable embodiment illustrating how the black masking structures 113 may be configured in an out-of-phase arrangement (i.e., a phase offset of 180°). As shown in FIG. 12, a first zigzagging strip 113-1 and a non-adjacent third zigzagging strip 113-3 may have downward vertices aligned with dotted lines 304, whereas a second zigzagging strip 113-2 that is interposed between strips 113-1 and 113-3 may have upward vertices that are aligned with lines 304. The out-of-phase arrangement of FIG. 12 may yield more symmetrical pixels and can thus improve optical performance and enhance viewing angles.

The foregoing is merely illustrative and various modifications can be made by those skilled in the art without departing from the scope and spirit of the described embodiments. The foregoing embodiments may be implemented individually or in any combination.

What is claimed is:

1. A display, comprising:
a color upper stage having color filter elements;
a monochromatic lower stage;
black masking structures that are formed in the monochromatic lower stage and that are formed in a zigzagging arrangement; and
a backlight unit, wherein the monochromatic lower stage is interposed between the backlight unit and the color upper stage.

2. The display defined in claim 1, further comprising:
additional black masking structures that are formed in the color upper stage and that are formed in a straight arrangement.

3. The display defined in claim 2, wherein the black masking structures include adjacent zigzagging strips that are separated by a first pitch, and wherein the additional black masking structures include adjacent straight strips that are separated by a second pitch that is less than the first pitch.

4. The display defined in claim 1, further comprising:
pixels formed in the monochromatic lower stage; and
gate lines that are coupled to the pixels formed in the monochromatic lower stage and that are covered by the black masking structures.

5. The display defined in claim 1, further comprising:
pixels formed in the monochromatic lower stage; and
data lines that are coupled to the pixels formed in the monochromatic lower stage and that are covered by the black masking structures.

6. The display defined in claim 1, wherein the black masking structures include adjacent zigzagging strips that are in-phase with each other.

7. The display defined in claim 1, wherein the black masking structures include adjacent zigzagging strips that are out-of-phase with each other.

8. The display defined in claim 1, wherein the black masking structures include adjacent zigzagging strips having a non-zero phase offset with respect to each other.

9. The display defined in claim 1, further comprising:
a diffuser interposed between the color upper stage and the monochromatic lower stage.

10. A two-stage display, comprising:
a color stage having pixels with a first pixel pitch;
a monochromatic stage having pixels with a second pitch that is greater than the first pitch;

first black masking strips that are formed in the color stage; and second black masking strips that are formed in the monochromatic stage and that are angled with respect to the first black masking strips.

11. The two-stage display defined in claim 10, wherein the color stage includes color filter elements, and wherein the monochromatic stages lacks color filter elements.

12. The two-stage display defined in claim 10, wherein the second black masking strips comprise straight black masking strips and wherein the second black masking strips comprise zigzagging black masking strips.

13. The two-stage display defined in claim 10, wherein the monochromatic stage further includes:

a first substrate on which the pixels with the second pitch are formed; and a second substrate on which the second black masking strips are formed.

14. The two-stage display defined in claim 13, wherein the monochromatic stage further includes:

liquid crystal material interposed between the first and second substrate.

15. The two-stage display defined in claim 10, wherein the second black masking strips exhibit an angle that is between 20° and 60° with respect to the first black masking strips.

16. Display circuitry, comprising:

a color stage having a first layer of liquid crystal material and having pixels with a first pixel pitch;

a monochromatic stage having a second layer of liquid crystal material and having pixels with a second pixel pitch that is greater than the first pixel pitch; and straight opaque lines formed in the color stage; and opaque light blocking structures that are formed in the monochromatic stage and that are angled with respect to the straight opaque lines.

17. The display circuitry defined in claim 16, wherein the opaque light block structures comprise opaque light blocking structures configured in a zigzagging pattern.

18. The display circuitry defined in claim 16, wherein the opaque light blocking structures comprise adjacent opaque zigzagging strips that are in-phase with each other.

19. The display circuitry defined in claim 16, wherein the opaque light blocking structures comprise adjacent opaque zigzagging strips that are phase offset from each other.

20. The display circuitry defined in claim 19, wherein the opaque light blocking structures comprise adjacent opaque zigzagging strips that are phase offset by 180° with respect to each other.

* * * * *